US005695292A

United States Patent [19]

Coote

[11] Patent Number: 5,695,292

[45] Date of Patent: Dec. 9, 1997

[54] THERMAL TRANSFER RIBBON CASSETTE SYSTEM

[75] Inventor: Michael John Coote, Harwich, United Kingdom

[73] Assignee: Imperial Chemical Industries PLC, United Kingdom

[21] Appl. No.: 682,674

[22] PCT Filed: Jan. 20, 1995

[86] PCT No.: PCT/GB95/00107

§ 371 Date: Oct. 9, 1996

§ 102(e) Date: Oct. 9, 1996

[87] PCT Pub. No.: WO95/20490

PCT Pub. Date: Aug. 3, 1995

[30] Foreign Application Priority Data

Jan. 27, 1994 [GB] United Kingdom ..... 9401544

[51] Int. Cl.[6] ..... B41J 35/00

[52] U.S. Cl. ..... 400/250; 400/208.1

[58] Field of Search ..... 400/207, 208, 400/208.1, 242, 246, 250; 242/538.3, 570, 571.4, 571.5, 571.8, 572, 578, 578.2

[56] References Cited

U.S. PATENT DOCUMENTS 5,248,208 9/1993 Yoshida et al. ..... 400/208.1
5,399,035 3/1995 Nakae ..... 400/208
5,433,540 7/1995 Alday ..... 400/250
5,605,403 2/1997 Vegeais et al. ..... 400/207

FOREIGN PATENT DOCUMENTS 2-208080 8/1990 Japan ..... 400/250

*Primary Examiner*—Ren Yan

[57] ABSTRACT

A thermal transfer ribbon cassette system for use with a thermal transfer printer comprises supply and take-up spools, a thermal transfer ribbon extending between the spools with one end loaded onto the supply spool and the other onto the take-up spool, a cassette casing (10) with spool-locating means (15, 16) to locate and retain the two ribbon-carrying spools (5) spaced-apart, parallel and rotatable during printing, the spacing between the spools being predetermined to fit the printer, and a disposable loading member (20) comprising a rigid body portion (21) shaped to be manually transportable and having spool-holding means (23) releasably to hold the loaded spools (5) parallel, non-rotatable and spaced apart with the same predetermined spacing as the spool-locating means (15, 16); the spools (5), casing (10) and loading member (20) being adapted to enable the spools (5) to be inserted into the spool-locating means (15, 16) of the casing (10) while being held by the loading member (20), and to enable the loading member (20) thereafter to be withdrawn while the spools (5) are retained in the casing (10).

6 Claims, 2 Drawing Sheets

THERMAL TRANSFER RIBBON CASSETTE SYSTEM

FIELD OF THE INVENTION

The invention relates to thermal transfer printing, and in particular to means for holding the thermal transfer ribbons during storage and during use in thermal transfer printers.

BACKGROUND OF THE INVENTION

Thermal transfer printing is a process for generating printed images by transferring thermally transferable colorant from a thermal transfer ribbon to a receiver. The ribbon usually comprises a base sheet coated on one side with a transfer coat comprising a non-transferable binder containing one or more thermally transferable dyes, or a fusible ink which is all transferable. Printing is effected while the transfer coat is held against the surface of the receiver, by heating selected areas of the ribbon so as to transfer the dyes or inks from those selected areas to corresponding areas of the receiver. This generates an image according to the areas selected. By repeating the transfer process with each of the three primary colours, full colour images can be obtained. Black may also be used.

Thermal transfer printers using a thermal head with a plurality of tiny heaters to heat the selected areas, have been gaining widespread attention in recent years, mainly because of its ease of operation in which the areas to be heated can be selected by electronic control of the heaters (e.g. according to a video or computer-generated signal), and because of the clear, high resolution images which can be obtained in this manner. Alternative thermal energy sources, such as addressable laser systems, are also being developed.

Transfer sheets for such primers are normally in the form of long ribbons, having repeated sequences of print size panels of each primary colour and any other materials to be transferred (e.g. black dyes or ink), such sequence being repeated along the ribbon to enable it to be used for as many prints as there are repeats of the sequence. The ribbons are rolled up and stored in a cassette. These consist essentially of supply and take-up spools, the thermal transfer ribbon extending between the spools with one end loaded onto the supply spool and the other onto the take-up spool, and a casing having spool-locating means to locate and retain the spools spaced apart, parallel and rotatable during printing with the spacing between the spools being predetermined to fit the printer. The cassettes may also be supplied with a small anti-rotation member which is plugged into the ends of the spools to prevent their rotation during transit to the consumer.

Cassette casings typically comprise two parallel spool-housings having end portions interconnected by bridge members such that the housings and bridge members together define an open access port through which the transfer ribbon is exposed as it extends from one spool to the other. However, there is at present no overall industry standard for thermal transfer printers and cassettes, and the specific configurations of the latter are largely determined by the printers with which they are to be used, both in respect of the overall shape and size (e.g. they must fit correctly into the space provided), and also in respect of the functional requirements (e.g. they must meet the requirements of various sensors normally built into the printer). There may also be differences between cassettes for printers using thermal heads to effect transfer and those which are laser driven.

Such casings can represent a substantial proportion of the cost of the cassette, but after all the transfer ribbon has been used up, they are usually discarded. However, some known cassettes do have an open configuration which leaves the spools and their spent transfer ribbons accessible for replacement. Such replacement may be facilitated by permitting longitudinal movement of the spools in the casing from a free to a retained position, and some form of spring, e.g. leaf springs or coil springs around the spool ends, provided to bias the spools into their retained positions.

Unfortunately, ribbon replacement is not without its difficulties. The colorants used in the ribbons are intended to be readily transferred to a receiver on application of heat, and when handled some of the colorant may become similarly transferred to the hands or clothing. Moreover the transfer sheet can itself become damaged by such handling, even when no colorant is actually transferred. Particularly susceptible to this are transfer coats comprising thermally transferable dyes held in a static binder from which they diffuse during printing, because such dyes are generally soluble in finger grease. Where the transfer coats are handled, any grease deposited may cause such dyes to diffuse to the surface where they accumulate and form crystals. These make the transfer sheets even more dirty, and may produce noticeable unevenness in a print made from that part of the transfer sheet.

SUMMARY OF THE INVENTION

We have now invented a cassette system wherein the ribbon can more easily be replaced with a new refill without contact between the transfer coat and the operator's hands, and the refill can be packaged in a form ready to be inserted into the casing by the consumer.

According to a first aspect of the present invention there is provided a thermal transfer ribbon cassette system for use with a thermal transfer printer, the system comprising supply and take-up spools, a thermal transfer ribbon extending between the spools with one end loaded onto the supply spool and the other onto the take-up spool, and a cassette casing with spool-locating means to locate and retain the two ribbon-carrying spools spaced-apart, parallel and rotatable during printing, the spacing between the spools being predetermined to fit the printer; the system also including a disposable loading member comprising a rigid body portion shaped to be manually transportable and having spool-holding means releasably to hold the loaded spools parallel, non-rotatable and spaced apart with the same predetermined spacing as the spool-locating means; the spools, casing and loading member being adapted to enable the spools to be inserted into the spool-locating means of the casing while being held by the loading member, and to enable the loading member thereafter to be withdrawn while the spools are retained in the casing.

A purpose of the loading member is to enable an operator to hold a refill manually by the loading member rather than by the loaded spools. Consequently these need to shaped to be manually transportable, but such shaping can be minimal provided the function is available. Thus for example, the body may be moulded with an integral handle, which provides an economical way of shaping the body portion to be comfortable to hold and transport manually, with the advantage of improved rigidity; but there are also suitable alternatives, including forming an integral flange around part or all the periphery of the body portion to give a broader edge that can be gripped twixt finger and thumb, for example. In extreme cases the body may be moulded with sufficient thickness to enable it to be gripped without such peripheral flanges, eg by having a foamed core, but this may not be the most economical way to provide manual transportability.

Supply and take-up spools typically have two end portions located either side of a bobbin portion onto which the respective ends of the thermal transfer ribbon are loaded, with one corresponding end portion of each spool being hollow by way of having an axial cavity for engaging driving means in the printer. The spool-holding means of the loading member can then comprise two parallel spaced-apart rods extending orthogonally from the body portion to fit securely but releasably in the respective cavities. The simplest way of gripping the spools is then for the rods to have extended end portions which are an interference fit in the respective cavities. The lengths of the rods and cavity depths need only to be sufficient to hold the loaded spools parallel as they extend from the body portion. When the rods are pushed home sufficiently to support the spools, they can also prevent rotation of the spindles during transit, and can be withdrawn after the refill has been located in the casing, simply by overcoming the friction of the interference fit.

A preferred cassette system is one wherein each spool-locating means for locating and retaining the hollow end portion of a spool comprises two arcuate upstands forming a major portion of an incomplete retaining ring with a gap between the ends of the upstands which is less than the external diameter of the hollow end portion of the spool, and each of the rods has at least a portion with a smaller diameter than the spool, being less than the width of the gap, and wherein the retaining rings are of a size to receive the hollow end portions with freedom for the spools and rods to move axially between a free position in which the smaller diameter portion is aligned with the gap to enable it to pass therethrough, and a retained position in which the hollow end portion is aligned with the gap to prevent the spool passing therethrough, whereby the spools held on the holding means can be inserted into the free position within the cassette by passing the rods through the gaps, then moved axially into the retained position and the holding means separated and removed. The casing suitably contains means to bias the spools from the free position into the retained position, thereby to maintain the spools in the retained position after removal of the spool-holding means.

Each of the rods with a diameter which provides an interference fit in the spool cavity, suitably has the diameter which is less than the width of the gap provided as a reduced diameter in just an intermediate portion of the rod. This gives a waisted shape, as produced, for example, by a circumferential groove, but depending on the method of construction, we find it is often simpler to reduce the diameter of the intermediate portion of the rod in one diametric direction only, by the provision of a slot on each side of the rod.

According to a second aspect of the present invention there is provided a refill unit for a thermal transfer ribbon cassette having a casing with spool-locating means to locate and releasably secure two ribbon-carrying spools spaced-apart, parallel and rotatable during printing, the refill unit comprising supply and take-up spools having a thermal transfer ribbon loaded onto and extending between them, and a disposable loading member comprising a rigid body portion shaped to be manually transportable and having spaced spool-holding means holding the loaded spools and maintaining them parallel, non-rotatable and spaced apart with the same predetermined spacing as the spool-locating means, said loading means being releasable from the spools after the latter have been loaded into and are retained by the spool-locating means.

According to a third aspect of the present invention, a method of refilling a thermal transfer cassette having a casing with spaced spool-locating means, comprises the steps of loading a thermal transfer ribbon onto a pair of spools, providing a loading member comprising a rigid body having spaced means for holding the loaded spools, engaging the spool-holding means and the spools so that the latter are held parallel, non-rotatable and spaced apart with the same spacing as the spool-locating means, inserting the spools into the casing while held by the loading member, thereafter allowing or causing relative movement between the casing and the spools until the spools are held by the spool-locating means, releasing the spools from the loading member and withdrawing the latter leaving the loaded spools retained in the casing.

The cassette system and refill unit of the present invention provide a number of advantages over previously known cassettes and refill methods. In particular it reduces the amount of wasted material and expense by enabling discarded mouldings to be limited to a minimal loading member, rather than a full cassette casing. This frees the cassette designer to produce a cassette with optimum performance characteristics, such as including reinforcement to give optimum rigidity, without commercial constraints of minimising the cost of mouldings discarded with the used ribbons. Compared with other refillable systems, the provision of the loading member enables a non-technical consumer to perform the refilling act without risk of damaging the ribbon or soiling their hands or clothes, because all that needs to be handled is the loading member.

As may have been noted from the above discussions of the prior art, cassettes have previously been supplied with small disposable anti-rotation devices which plugged into the ends of the spools to prevent their rotation during transit to the consumer. However, these were employed with filled cassettes, rather than refills, and were not suitable for use with those cassettes as a loading member according to the present invention.

BRIEF DESCRIPTION OF THE DRAWINGS

To illustrate the invention, a specific embodiment thereof is shown in the accompanying drawings, in which.

DETAILED DESCRIPTION OF THE INVENTION

Figure 1:
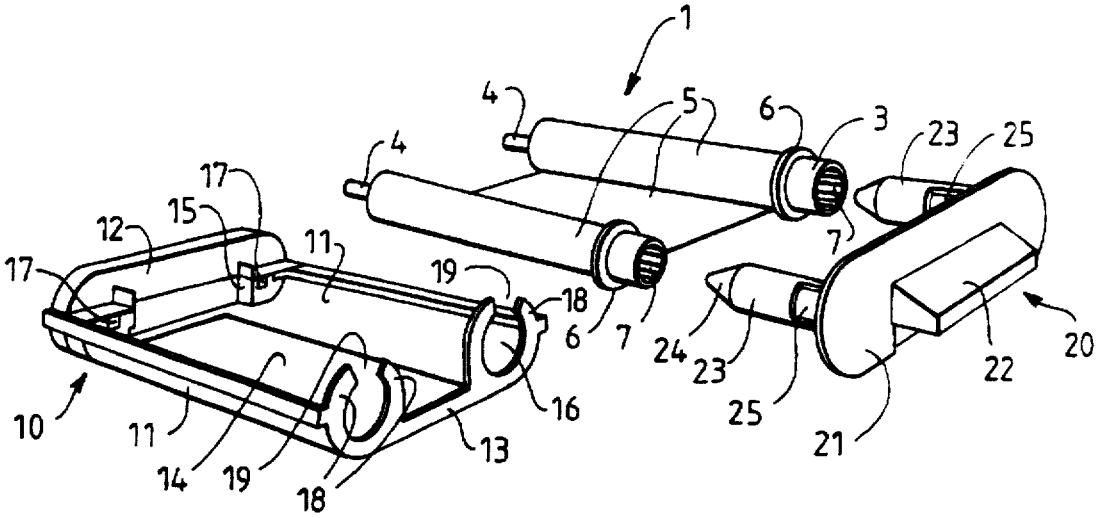
FIG. 1 is an exploded perspective view of a cassette system according to the invention, showing a refill, casing and loading member all separate.

The refill 1 comprises two spools each having a broad spindle portion 3 at one end and a narrower spindle portion 4 at the other. Between the two spindle portions are bobbin portions (obscured) on which are wound a dyesheet ribbon 5. Between the broad spindle portion 3 and the bobbin portion is provided a circumferential flange 6. The broad spindle portions are hollow, having an axial printer-drive-receiving cavity 7 with internal knurls for engaging driving means in the printer.

Figure 3:
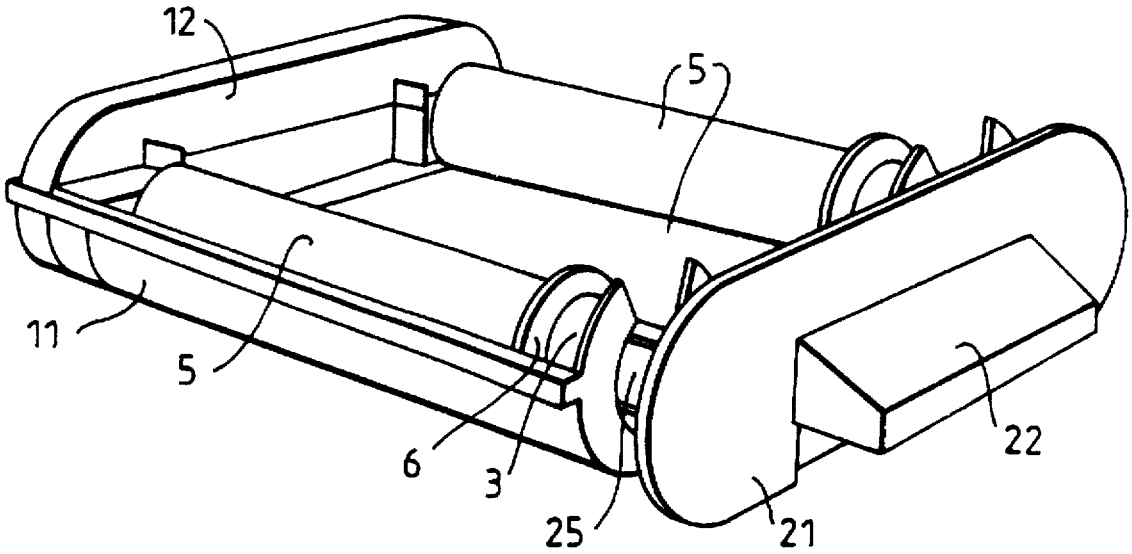
FIG. 3 is a similar view to the above, with the refill inserted into the casing while held on the loading member.
Figure 4:
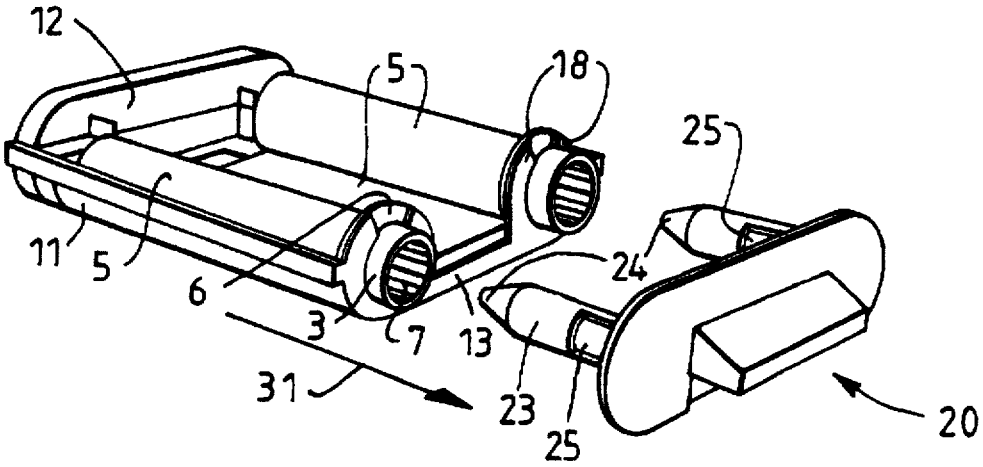
FIG. 4 is a similar view wherein the loading member has been withdrawn from the refill. Like reference numerals having been used for like parts in all four drawings.

The casing 10 comprises two parallel spool-housings 11, having end portions interconnected by bridge members 12 and 13, such that the housings and bridge members together define an open access port 14. At each end of the housings are first and second spool-locating means 15 and 16 to receive corresponding end portions of the spools with freedom to move longitudinally between a free position as shown in FIG. 3, and a retained position as shown in FIG. 4. Each first spool-locating means 15 comprises a box with a spindle-receiving hole 17 and containing spring means (not shown) to bias the spools into the retained position, and each second locating means 16 comprises two arcuate upstands to form a major portion of an incomplete retaining ring 18, with a gap 19 between the ends of the upstands. The hole 17 and ring 18 are sized to provide bearings in which the respective spindle portions of the spools can be rotatably mounted, and to provide retaining means to retain the spindle portions in the bearings when the spools are in the retained positions.

The loading member b comprises a rigid body portion 21 having an integral handle 22, and two spool-holding means. The latter are parallel rods 23 extending from the rigid body portion 21, each with tapered extended ends 24 and a waisted portion 25 formed by a recess on both sides only one of which can be shown on each rod). The rods 23 are a firm interference fit in the cavities 7 of the broad spindle portions 3 at one end of the spools. The integral handle provides an economical way of shaping the body portion to be comfortable to hold and transport manually, and improve the rigidity at the same time.

Figure 2:
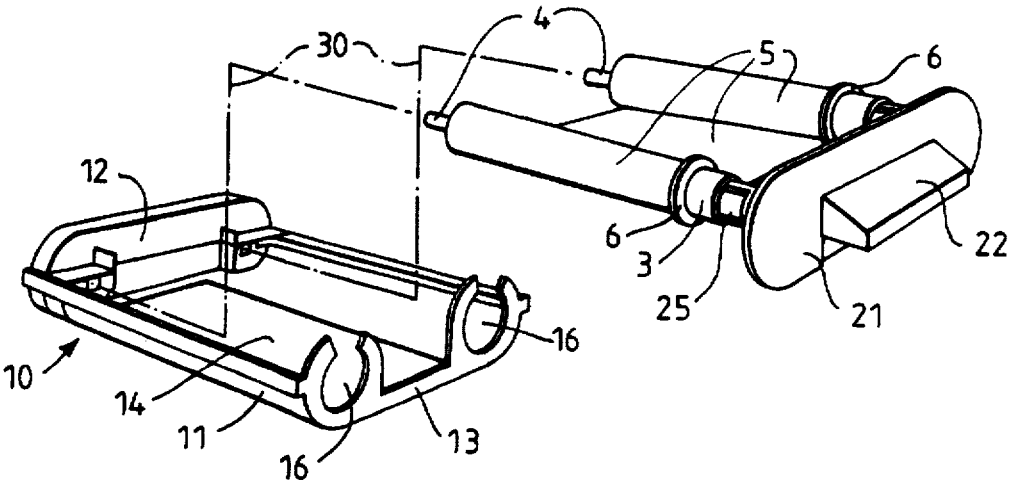
FIG. 2 is a view similar to that of FIG. 1, except that the refill is held by the loading member.

The refill unit is first assembled by combining the refill 1 and the loading member 20, as shown in FIG. 2. To achieve this the tapered extended ends 24 of rods 23 on the loading member, are pressed into the cavities 7 of the refill, up to but not including the waisted portion 25 of the rods. The interference fit between the rods 23 and the knurls in the cavity 7 provides the loading member with a good non-rotatable hold on the refill, whilst keeping the spools spaced apart and parallel. The refill unit can then readily be picked up and transported manually by using the handle 22, with little danger of the user inadvertently touching the spooled ribbon.

The refill unit is inserted into the casing as shown by guide lines 30 in FIG. 2. First the narrow spindle portions 4 are inserted into the holes 17 until resistance by the spring means in the boxes 15 is felt, and then continued until the waisted portions 25 of the rods 23 become adjacent to the gaps 19. The loading member is then lowered through the gaps so that those waisted portions enter into the rings 18 of the second bearings as shown in FIG. 3. This is the "free position" referred to above, in which the spindles are still free to be lifted out of the retaining rings 18 and removed.

On withdrawing the loading member from the hollow ends of the spools (as indicated by the arrow 31 in FIG. 4), bias from the spring means causes longitudinal movement of the refill spools in the casing from the free position shown in FIG. 3, until the flanges 6 contact the rings 18, and prevent further movement. In so moving the refill unit, the gaps 19 in the second bearing portions 16 come into alignment with the broader spindle ends of the spools 3 (instead of the waisted portions of the loading member rods), which are not able to pass back out through the gaps 19, thus retaining the refill in place. Hence this is the "retained position" referred to above, and is shown in FIG. 4.

The loading member thereafter plays no active role in the operation of the refilled cassette during printing, and may be discarded or recycled as part of a fresh refill unit, as desired. Being a smaller, simpler moulding than the cassette, whether the loading member is discarded or recycled, this represents an environmentally more friendly option than doing the same with the full cassette, and is a more user-friendly way of refilling the cassette than handling the refills directly.

I claim:

1. A thermal transfer ribbon cassette system for use with a thermal transfer printer, comprising:

supply and take-up spools, each having a corresponding end portion which is hollow with an axial cavity for engaging driving means in the printer;

a thermal transfer ribbon extending between the spools, with one end loaded onto the supply spool and the other onto the take-up spool;

a cassette casing with spool-locating means to locate and retain the two ribbon-carrying spools spaced-apart, parallel and rotatable during printing, the spacing between the spools being predetermined to fit the printer; and a disposable loading member to hold the spools parallel, spaced apart and non-rotatable while they are being inserted into the spool-locating means of the casing;

wherein the loading member comprises a rigid body portion shaped to be manually transportable, and two parallel spaced-apart rods extending orthogonally from the body portion with extended end portions to fit securely but releasably in the respective spool cavities;

the spool-locating means for locating the hollow ends of the spools, each comprises two arcuate upstands forming a major portion of an incomplete retaining ring, with a gap between the ends of the upstands which is less than the external diameter of the hollow end portion of the spool but greater than the diameter of at least an intermediate portion of the rod;

the retaining rings are of a size to receive the hollow end portions with freedom for the spools and rods to move axially between a free position in which the intermediate portion of the rod is aligned with the gap to enable it to pass therethrough, and a retained position in which the hollow end portion is aligned with the gap to prevent the spool passing therethrough;

whereby the two ribbon-loaded spools can be inserted into the cassette by holding the spools on the extended end portions of the rods, inserting the spools into the free position within the cassette by passing the intermediate portions of the rods through the gaps, moving the spools axially into their retained positions, and withdrawing the loading member from the spools while the latter are retained in the casing.

2. A cassette system as claimed in claim 1, wherein the extended end portions of the rods are an interference fit in the respective cavities.

3. A cassette system as claimed in claim 1, wherein the casing contains means to bias the spools from their free positions into their retained positions.

4. A cassette system as claimed in claim 1, wherein the diameter of the rod which is less than the width of the gap, is a reduced diameter provided in just the intermediate portion of the rod.

5. A cassette system as claimed in claim 4, wherein the diameter of the intermediate portion of the rod is reduced in one diametric direction only, by the provision of a slot on each side of the rod.

6. A refill unit for a thermal transfer ribbon cassette, wherein the refill unit and the cassette together form a cassette system as claimed in any one of claims 1 to 5, and wherein the refill unit comprises the supply and take-up spools with their axial cavities, the thermal transfer ribbon extending between the spools, and the disposable loading member with its rods fitted securely but releasably in the respective spool cavities to hold the spools parallel, non-rotatable and spaced apart, wherein said spools each have a broad spindle portion at one end and a narrower spindle portion at the other.

* * * * *